United States Patent [19]

Hildebrandt

[11] 3,959,792

[45] May 25, 1976

[54] DEVICE FOR THE FACILITATION AND SIMPLIFICATION OF THE ADJUSTMENT OF RESONATORS OF AN ANSWERING DEVICE IN A MICROWAVE RAILROAD VEHICLE IDENTIFICATION SYSTEM

[75] Inventor: Bernhard Hildebrandt, Hochbrueck near Garching, Germany

[73] Assignee: Siemens Aktiengesellschaft, Berlin & Munich, Germany

[22] Filed: May 9, 1974

[21] Appl. No.: 468,391

[30] Foreign Application Priority Data

June 15, 1973 Germany ..... 2330580

[52] U.S. Cl. ..... 343/6.5 SS; 343/6.8 R

[51] Int. Cl.[2] ..... G01S 9/56

[58] Field of Search ..... 343/6.5 R, 6.5 LC, 6.5 SS, 343/6.8 R, 6.8 LC

[56] References Cited

UNITED STATES PATENTS

| | | | |
|---|---|---|---|
| 3,353,178 | 11/1967 | Wasterlid | 343/6.5 SS |
| 3,399,405 | 8/1968 | Daniel | 343/6.5 SS |
| 3,406,391 | 10/1968 | Le Von | 343/6.5 SS |
| 3,521,280 | 7/1970 | Janco et al. | 343/6.5 SS |
| 3,878,528 | 4/1975 | Majeau | 343/6.5 SS |

*Primary Examiner*—T. H. Tubbesing
*Attorney, Agent, or Firm*—Hill, Gross, Simpson, Van Santen, Steadman, Chiara & Simpson

[57] ABSTRACT

A device for the facilitation and simplification of the adjustment of resonators of an answering device coupled to a high frequency line, for a microwave transmission system for railroad vehicles or information assigned to certain points with several digits employs a separate frequency range with frequencies provided for the characterization of an alphanumeric symbol and periodic switching through the transmission frequency band which transmits an interrogation signal from an interrogation device and receives selectively frequency modulated signals by the resonators of the answering device. Successive frequency ranges of the transmission frequency band are assigned in a sequence differing from the digit sequence of the information to be transmitted. The resonators are optimally coupled with respect to oscillations to the electromagnetic field of the high frequency line and the interrogation device includes, in a receiving branch thereof, a digit sorter which arranges the signals created by the resonators into respective digit stores which are arranged according to the digit sequence.

3 Claims, 6 Drawing Figures

DIGIT STORERS
161
162
171
1612 1611 1610
1602 1601
16
1712
1701
17
GATE BLOCK
MATRIX
18
193
192
19
1912 1911 1910
DIGIT STORERS
1903 1902 1901

DEVICE FOR THE FACILITATION AND SIMPLIFICATION OF THE ADJUSTMENT OF RESONATORS OF AN ANSWERING DEVICE IN A MICROWAVE RAILROAD VEHICLE IDENTIFICATION SYSTEM

BACKGROUND OF THE INVENTION

1. Field of the Invention

This invention relates to a device for facilitating and simplifying the adjustment of resonators of an answering device coupled to a high frequency line for a microwave transmission system for information assigned to railroad vehicles or distance points with several digits which are each provided with a separate frequency range with frequency locations within a periodic transmission frequency band for the characterizing of an alphanumeric symbol, which information is transmitted from an interrogation device as an interrogation signal and is received again selectively frequency modulated by the resonators of the interrogation device.

2. Description of the Prior Art

Answering devices are known in the art which have been developed for such transmission systems. In this connection one may refer to German Letters Patent 1,290,611 and the German published application 2,047,153. In this system for the characterization of an alphanumeric symbol, two-out-of-five frequencies are provided within a frequency range of the transmission frequency band for each digit of information. These two frequencies are, in each case, provided with resonance pulses which are created in resonators. Therefore, the answer signal of an answering device receives for each digit of the information to be transmitted two resonance pulses so that in the case of a twelve digit informaion, therefore, 24 resonance pulses are provided. During the assignment of the frequency range of the transmission frequency band, successive digits of an information may be assigned also in the transmission frequency band of subsequent frequency ranges.

Basically, an answering device comprises a horn antenna, a hollow conductor coupled thereto as a high frequency line, and a short circuit plane closing off the hollow conductor at the other end. For technical production reasons such an answering device can preferably be produced of two half shells, whereby at the uncut longitudinal sides of the hollow conductor at least as many coupled coaxial line resonators are cast as there are digits in the information to be transmitted. For interference free operation of the entire system, it is of considerable importance that the resonators have a slight attenuation and are optimally coupled, with respect to oscillations, to the electromagnetic field in the hollow conductor. Slight attenuation of the resonators can generally also be achieved by a large dimensions of the resonator interior, which means its diameter should be chosen as large as possible.

In the interest of miniaturization, the hollow conductor should also be as short as possible, whereby there are only a few possibilities for the selection of the arrangement of the resonators at the hollow conductor. The distance of a resonator from the short circuit plane of the hollow conductor is basically prescribed by the position of its resonant frequency within the transmission frequency band. Each resonator should, if possible, have a distance to the short circuit plane which corresponds to a quarter or an uneven multiple of a quarter of the wave length of its resonant frequency. In such an optimum coupling of the resonators to the hollow conductor, and during the assignment of subsequent digits of the information to frequency ranges following each other in the transmission frequency band, the individual digits of the information respectively assigned resonators at the hollow conductor are secondary in such a way that during the adjustment of the resonators errors occur easily due to the confusing arrangement.

SUMMARY OF THE INVENTION

The primary object of the present invention, therefore, is to provide a device for facilitating and simplifying the adjustment of resonators in a transmission system of the type described above, without endangering the high read out safety of such a system.

According to the invention, the aforementioned object is achieved in that successive frequency ranges within the transmission frequency band are assigned in a sequence to the successive digits, which sequence differs from the digit sequence of the information to be transmitted. The resonators are optimally coupled, with respect to oscillation, irrespective of their digit assignment, to the electromagnetic field of the high frequency line and in the receiving branch of the interrogation device a digit sorter is provided which assigns the signals created by the resonators to respectively provided digit storers arranged according to the digit sequence.

According to a feature of the invention a digit sorter can be provided which includes a number of digit storers corresponding to the number of digits of the information which are connected via respective transmission means to a set of digit storers which are arranged according to the digit sequence.

Especially advantageous, and according to another feature of the invention, a gate circuit can be connected to the outputs of successively arranged first digit storers which, during a setting pulse at its setting input, transfers the respective digit information of the first digit storers to second digit storers which are arranged according to the digit sequence.

On the other hand, and also according to a further feature of the invention, each digit storer can be provided with an input and an output circuit which are connected with each other corresponding to the digit assignment and can be controlled by a separate timing pulses.

BRIEF DESCRIPTION OF THE DRAWINGS

Other objects, features and advantages of the invention, its organization, construction and operation will be best understood from the following detailed description taken in conjunction with the accompanying drawings, on which.

DESCRIPTION OF THE PREFERRED EMBODIMENTS

Figure 1:
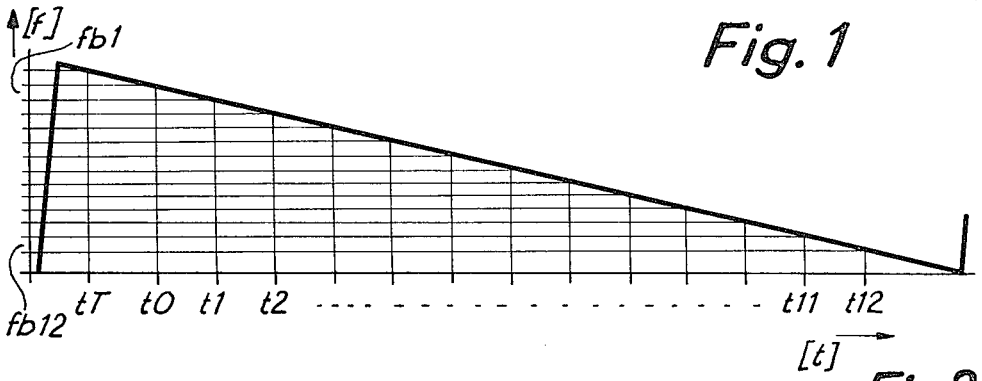
FIG. 1 is a graphic illustration of the transmission frequency band with respect to time during a switching period and the distribution of the frequency band into a number of frequency ranges corresponding to respective digits of an information.
Figure 3:
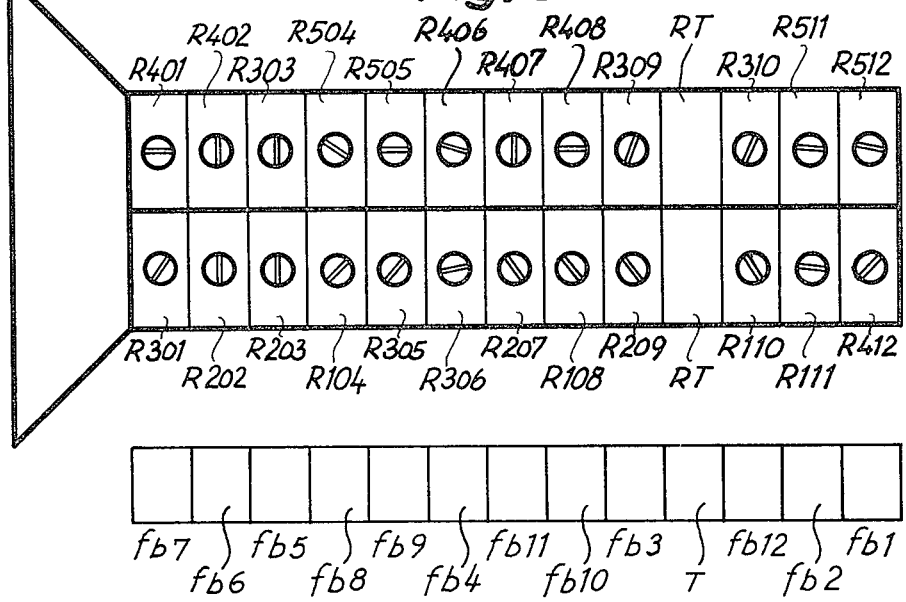
FIG. 3 schematically illustrates the arrangement of resonators in an answering device with the resonators being arranged in pairs in a sequence next to each other.
Figure 4:
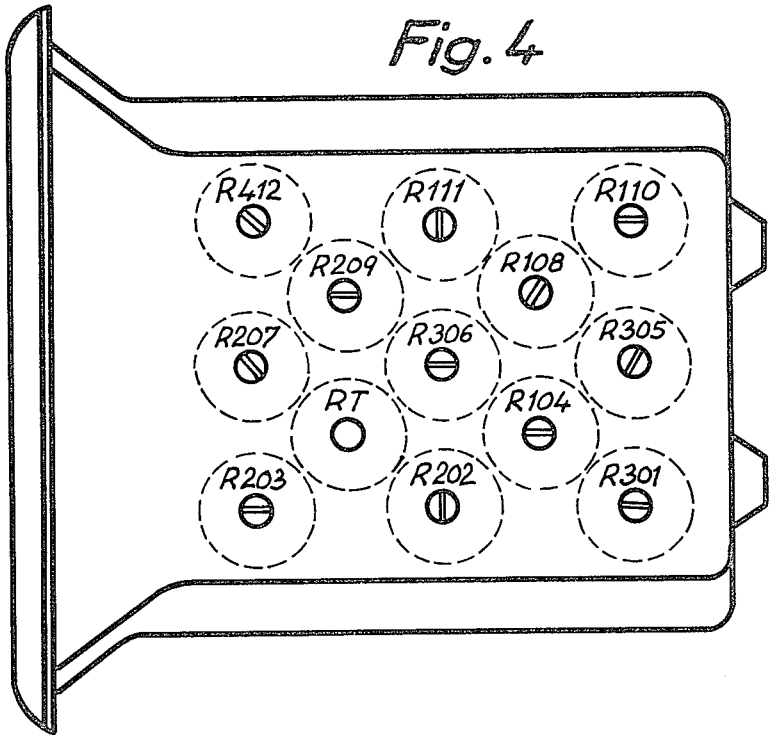
FIG. 4 illustrates a half shell of an answering device which carries a resonator for each digit of the information.

Referring to FIG. 1, the course of an interrogation signal frequency f during a switching period of the microwave transmitter is illustrated. At first, during the recourse of a switching generator (not illustrated) the frequency *f* increases sharply. Shortly after the beginning of the switching period to the time *t*T, the interrogation signal frequency f passes over the resonant frequency *f*T of a special resonator RT which is provided for a temperature comparison (FIGS. 3 and 4). The resonator RT releases the pulse T illustrated in FIG. 2. Between the time *t*0 and *t*1, *t*1, and *t*2, *t*3, and *t*4, and so on up to t11 and t12, the frequency ranges ft1 to ft12 are covered. Within the boundaries of these frequency ranges there are, in each case, two resonant frequencies covered by adjusted resonators in the answering device which, for example, constitute in a (2-out-of-5) code an alphanumeric symbol for each digit of the information. The resonant pulses from each frequency range *fb*1 to *fb*12 created by the resonators are, for example, illustrated in the upper half of FIG. 2.

If the technical coupling of the oscillation of the resonators would be superfluous, the resonators assigned to the successively covered frequency ranges *fb*1 to *fb*12 and the likewise successive digits S1 to S12 of the information could be coupled in a mechanically arranged sequence to the high frequency line. However, according to the invention, the optimum coupling of the resonators to the electromagnetic field of the hollow conductor is necessary and the successive frequency ranges in a sequence differing from the digit sequence of the information to be transmitted are assigned to the successive digits. This differing sequence corresponds, for example, to the assignment of the successively covered frequency ranges schematically illustrated in FIG. 2 to the individual digits of the information to be transmitted. For example, the twelve digit S12 is assigned to the frequency range *fb*1, the eleventh digit s11 of the information to the frequency range *fb* 2, and the frequency range *fb*12 has assigned thereto the tenth digit S10.

In FIGS. 3 and 4, two examples of an answering device are represented. The resonators are indicated by the letter R and a three-figure number of which, in each case, the first digit is the frequency position within a certain frequency range according to FIG. 2, and the two last digits give the place number of the information to be transmitted. In the lower section of FIG. 3, the frequency ranges are given which are assigned to the resonators represented in the upper part of FIG. 3. Therefore, for example, the resonator R401 is coordinated to the fourth frequency position and the resonator R301 to the third position of the frequency range *fb*7. Both the resonators jointly provide the figure for the first position of the information to be transmitted. The spacings of the resonators R301, R305 and R110 from the right-hand and short-circuit plane R, respectively, 15/4λ, 9/4λ, and 3/4λ, where λ is the wave length of the microwave resonant frequency in each particular case.

FIG. 4 illustrates only a half shell of an exemplary embodiment for another answering device. In this apparatus only one resonator of each pair is located on one side of the shell and the second is located on the other half of the shell which is not seen in the drawing. The resonators designated with the references R301, R202, R203, R104, RT, R305, etc, correspond to the resonators arranged in the lower series illustrated in FIG. 3 and are assigned to the respective digits of the information.

Figure 2:
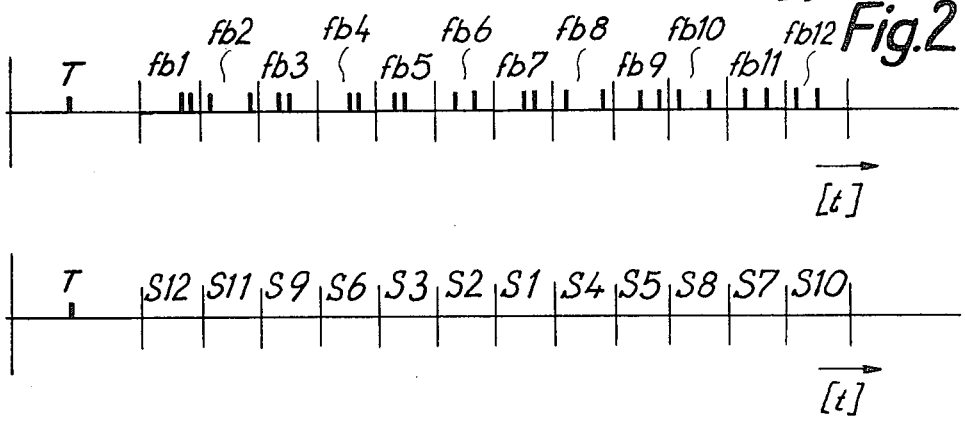
FIG. 2 illustrates the assignment of the successive frequency ranges to the individual digits of a twelve digit information corresponding to a sequence differing from the digit sequence in an exemplary embodiment.
Figure 5:
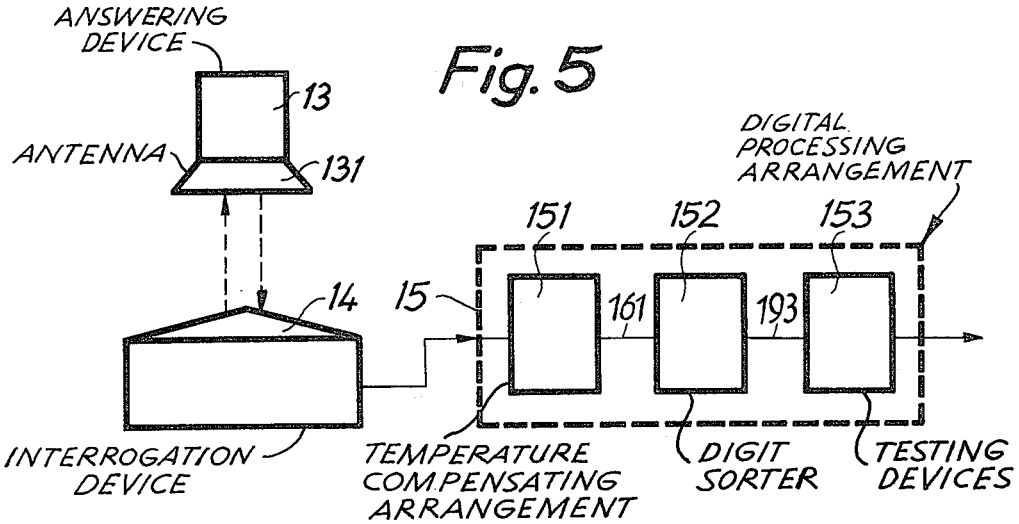
FIG. 5 is a schematic block diagram of a microwave transmission system and the arrangement of the digits in the system according to the present invention.

In order to feed the resonant pulses arriving in a time sequence in the interrogation device for the digits of the information arranged corresponding to the selected sequence illustrated in the lower diagram in FIG. 2 into the sequence corresponding to the digit sequence, a digit sorter 152 is provided in the interrogation device illustrated schematically in FIG. 5 as a block component. In FIG. 5, the schematically illustrated answering device 13 includes an antenna 131 which is directed to the transmission and receiving antenna, (not illustrated) of the interrogation device 14. The interrogation device 14 is connected to a digital processing arrangement which contains a temperature compensation arrangement 151, the digit sorter 152 and further testing devices 153. These arrangements are connected with each other by the lines 161 and 193.

Figure 6:
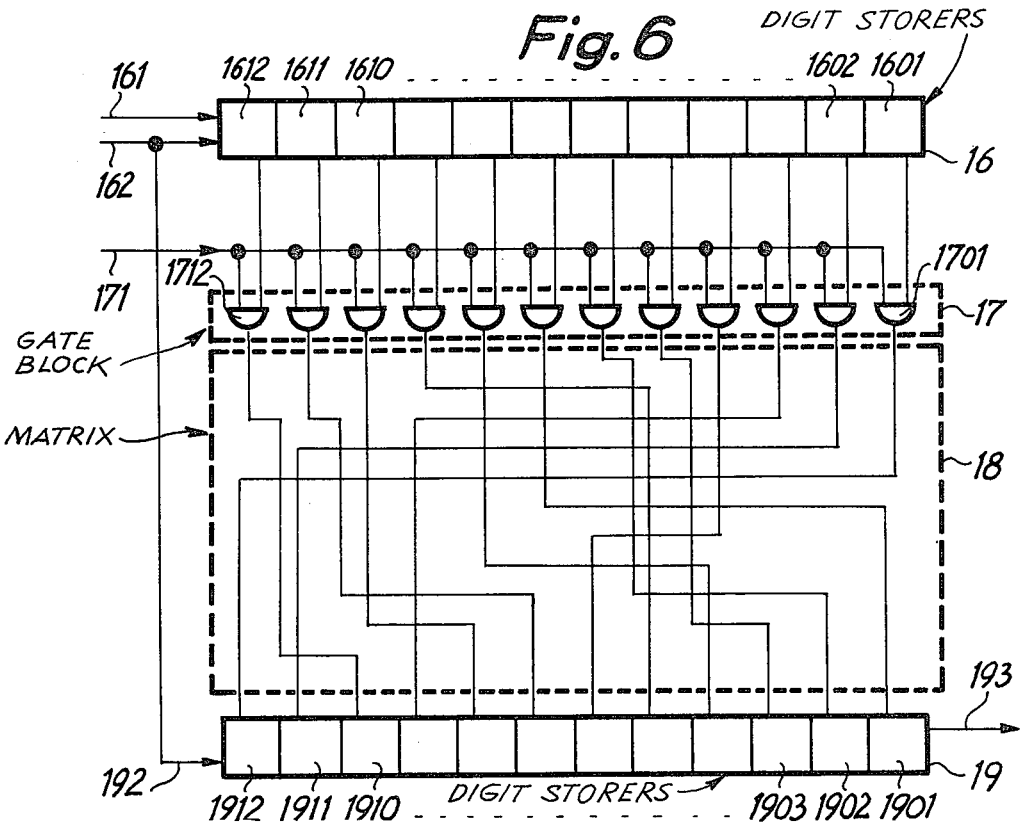
FIG. 6 is a schematic block diagram for a digit sorter with a parallel digit assignment.

In a preferred exemplary embodiment for the digit sorter 152 of FIG. 5 is illustrated in FIG. 6 for parallel digit processing. In this example, during an interim pulse, all digits of the transmitted information arranged corresponding to te selected sequence are converted in parallel into the desired information with digits arranged corresponding to the digit sequence. It is assumed for the illustrated example that the transmitted information has 12 digits. The information is stored successively via the line 161 by means of a shifter pulse applied to the line 162 to shift the information into the digit storers 1601 to 1612 which form the single block digit storer 16. The digit information transmitted first is stored in the digit storer 1601 and the digit information transmitted last is stored in the digit storer 1612. By means of an interim pulse of the line 171 which is applied to an input of each of twelve gate circuits 1701 to 1712 which form a gate block 17, the information is transferred from the digit storers 1601 to 1612 to a matrix 18 which may comprise, for example, a cross bar distributor. The digit storers 1901 to 1912 which are comprised into a second storage block 19 are connected to the matrix 18. The digit information is arranged into these digit storers by the connections of the matrix 18 corresponding to te digit sequence and the information is stored during the interim pulse on the line 171 into the second storage block 19. The information arranged in the second storage block 19 corresponds to the digit sequence and is directed with the following shifter pulses on the line 193 to the further testing arrangements 153 of FIG. 5.

If for any reason a different sequence should result for the arrangement of the resonators in the answering device, the digit sorter may be adapted to the new arrangement without difficulty by exchanging the matrix 18 for a matrix having connections to effect the correct digit sequence.

Although I have described my invention by reference to particular illustrative embodiments thereof, many changes and modifications of the invention may become apparent to those skilled in the art without departing from the spirit and scope of the invention. I therefore intend to include within the patent warrented hereon all such changes and modifications as may resonably and properly be included within the scope of my contribution to the art.

I claim:

1. In a microwave transmission system in which a number of digits as an information represent an alphanumeric symbol to identify a location of, for example, a railroad vehicle, and in which the information is, in each case, periodically switched through and transmitted in a transmission band, the information being transmitted from an interrogation device and received again selectively frequency modulated by the resonators of an answering device, the improvement therein comprising:

a device for facilitating and simplifying adjustment of the resonators including means for receiving the information comprising a high frequency line having an electromagnetic field and receiving the digits in separate successive frequency bands within the transmission band and in a first sequence which differs from the digit sequence of the information, the resonators being optimally coupled to said high frequency line, and a receiving branch in said device including a digit sorter for arranging the digits received in said first sequence into the digit sequence of the information.

2. In a transmission system according to claim 1, wherein said digit sorter comprises a number of sequentially arranged first digit storers, a plurality of transmission means individually connected to respective ones of said first digit storers, and a plurality of second digit storers connected to respective ones of said transmission means and arranged according to the digit sequence of the information, said first digit storers transferring the digits to said second digit storers via said transmission means.

3. In a system according to claim 1, wherein said digit sorter comprises a plurality of digit storers each including an input circuit and an output circuit, said input circuits and output circuits interconnected with each other corresponding to the digit sequence and controlled by separate timing pulses.

* * * * *